US011793281B2

(12) United States Patent
Abel

(10) Patent No.: US 11,793,281 B2
(45) Date of Patent: Oct. 24, 2023

(54) EAR-PIERCING DEVICE

(71) Applicant: Randy James Abel, Winston, GA (US)

(72) Inventor: Randy James Abel, Winston, GA (US)

( * ) Notice: Subject to any disclaimer, the term of this patent is extended or adjusted under 35 U.S.C. 154(b) by 356 days.

(21) Appl. No.: 17/334,591

(22) Filed: May 28, 2021

(65) Prior Publication Data

US 2021/0282512 A1 Sep. 16, 2021

Related U.S. Application Data

(60) Provisional application No. 63/156,112, filed on Mar. 3, 2021.

(51) Int. Cl.
*A44C 7/00* (2006.01)

(52) U.S. Cl.
CPC ..... *A44C 7/001* (2013.01)

(58) Field of Classification Search
CPC ..... A44C 7/001; A44C 7/003; A44C 15/0035; A44C 7/00; A01K 11/001; A01K 11/002; A61B 17/1679; A61B 17/00; A61B 17/34
See application file for complete search history.

(56) References Cited

U.S. PATENT DOCUMENTS

| | | | | |
|---|---|---|---|---|
| 4,146,032 | A * | 3/1979 | Rubenstein | A44C 7/001 606/188 |
| 5,925,057 | A * | 7/1999 | Blomdahl | A44C 7/001 606/188 |
| 8,469,988 | B2 * | 6/2013 | Reil | A44C 7/001 606/188 |
| 2008/0208237 | A1 * | 8/2008 | Lei | A44C 7/001 606/188 |

* cited by examiner

*Primary Examiner* — Elizabeth Houston
*Assistant Examiner* — Uyen N Vo
(74) *Attorney, Agent, or Firm* — Barry Choobin; Patent 360

(57) ABSTRACT

An ear-piercing device of a gun shape that can pierce an ear lobe quickly with less pain. The ear-piercing device includes a frame, a handle, and a plunger unit coupled to the frame. The plunger unit includes a plunger and a compression spring. A cartridge can interchangeably be coupled to the frame, wherein the cartridge includes a piercing member that can be driven by the plunger and protrudes from the housing into a compression module. The housing and compression module can clamp the ear lobe, and the piercing member can make a hole in the ear lobe. The compression module can include a cutter to snip off the portion of the piercing member inserted into the compression module. The piercing member includes a sleeve part and a needle part. The needle part makes the hole and the needle part and portion of the sleeve get snip off, while a portion of the sleeve is retained in the ear lobe.

14 Claims, 7 Drawing Sheets

EAR-PIERCING DEVICE

CROSS-REFERENCE TO RELATED APPLICATIONS

This application claims priority from the U.S. provisional patent application Ser. No. 63/156,112 filed on Mar. 3, 2021, which is incorporated herein by reference in its entirety.

FIELD OF INVENTION

The present invention relates to an ear-piercing device, and more particularly, the present invention relates to a gun shape ear piercing device having a spring-loaded plunger for driving the needle.

BACKGROUND

Ear piercing refers to making a fine hole in a lobe of an ear for wearing jewelry. It is a widespread tradition and generally done by manually inserting a sterilized needle. Thereafter a lightweight stud earring made of an inert material, such as silver is worn in the pierced ear for few months to prevent the closing of the piercing. The known methods for ear piercing have several disadvantages including being painful, require experienced handling of the needle, the stud earnings can lead to infection at the site of piercing and is often painful.

Thus, a long-term desire is there for a device and method for piercing an ear without the aforesaid drawbacks of known methods.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a device for ear piercing and a method of use thereof.

It is another object of the present invention that the device produces lesser or negligible pain in piercing the ear.

It is still another object of the present invention to provide a protective sleeve in the piercing.

It is yet another object of the present invention that the device is safe in use.

It is a further object of the present invention that the device is easy to use and makes ear piercing fun, exciting, and enjoyable.

It is still a further object of the present invention that the protective sleeve allows wearing the earrings just after piercing.

It is yet a further object of the present invention that the protective sleeve allows changing the earrings without pain or with negligible pain.

It is an additional object of the present invention that the disclosed device has high precision and accuracy in making the piercing.

In one aspect, disclosed is an ear-piercing device of a gun shape having a handle that can be gripped and a trigger that can be actuated by a finger of the hand gripping the handle. The handle is coupled to a frame on the top end. The frame having a proximal end and a distal end. The frame can be of an elongated planar geometry having an upstanding flange each at the proximal end and a distal end. The distal end of the frame can have a compression spring-loaded plunger, wherein the flange at the distal end can have an aperture through which the plunger can pass through. The frame can interchangeably receive a cartridge, wherein the frame and the cartridge can have interlocking mating members to couple the cartridge to the frame between the opposite flanges of the frame.

In one aspect, the cartridge can include a housing enclosing a pusher at the distal end of the housing, a piercing member within the housing removably coupled to the pusher, and an aperture at the proximal end of the housing through which the piercing member can protrude. The plunger can be inserted into the cartridge through an aperture in a wall of the housing and drives the pusher forward resulting in the pushing of the piercing member out from the cartridge. The plunger can be switched from its retracted position to the extended position by pushing the head of the plunger, wherein spring can be provided to restore the plunger from the extended position to the retracted position. The plunger can be locked in its extended position using a mating mechanism such as a snap lock. Actuating a trigger adjacent to the handle can release the snap lock and the plunger moves to its retracted position.

In one aspect, the piercing member can include an elongated sleeve part and a needle part. The sleeve can be of a diameter to fit into the piercing made by the needle in the ear lobe.

In one aspect, the cartridge further includes a compression module adjacent to the proximal end of the housing, wherein the compression module can be moved towards the housing against the compression of spring for clamping the ear lobe between the housing and the compression module. The compression module having a front wall and a rear wall, wherein the front wall can have an aperture for receiving the piercing member. Around the aperture is removably coupled a retention disk, the retention disk having an aperture concentric with the aperture in the front wall. The compression module can further include a cutter adjacent to the inner surface of the front wall, the cutter can cut the portion of the piercing member inserted into the compression module. The cutter can be actuated by a trigger, where the trigger can also release the compression module upon cutting the piercing member, wherein the compressed spring can move the compression module back to its original position.

These and other objects and advantages of the embodiments herein and the summary will become readily apparent from the following detailed description taken in conjunction with the accompanying drawings

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

Figure 1:
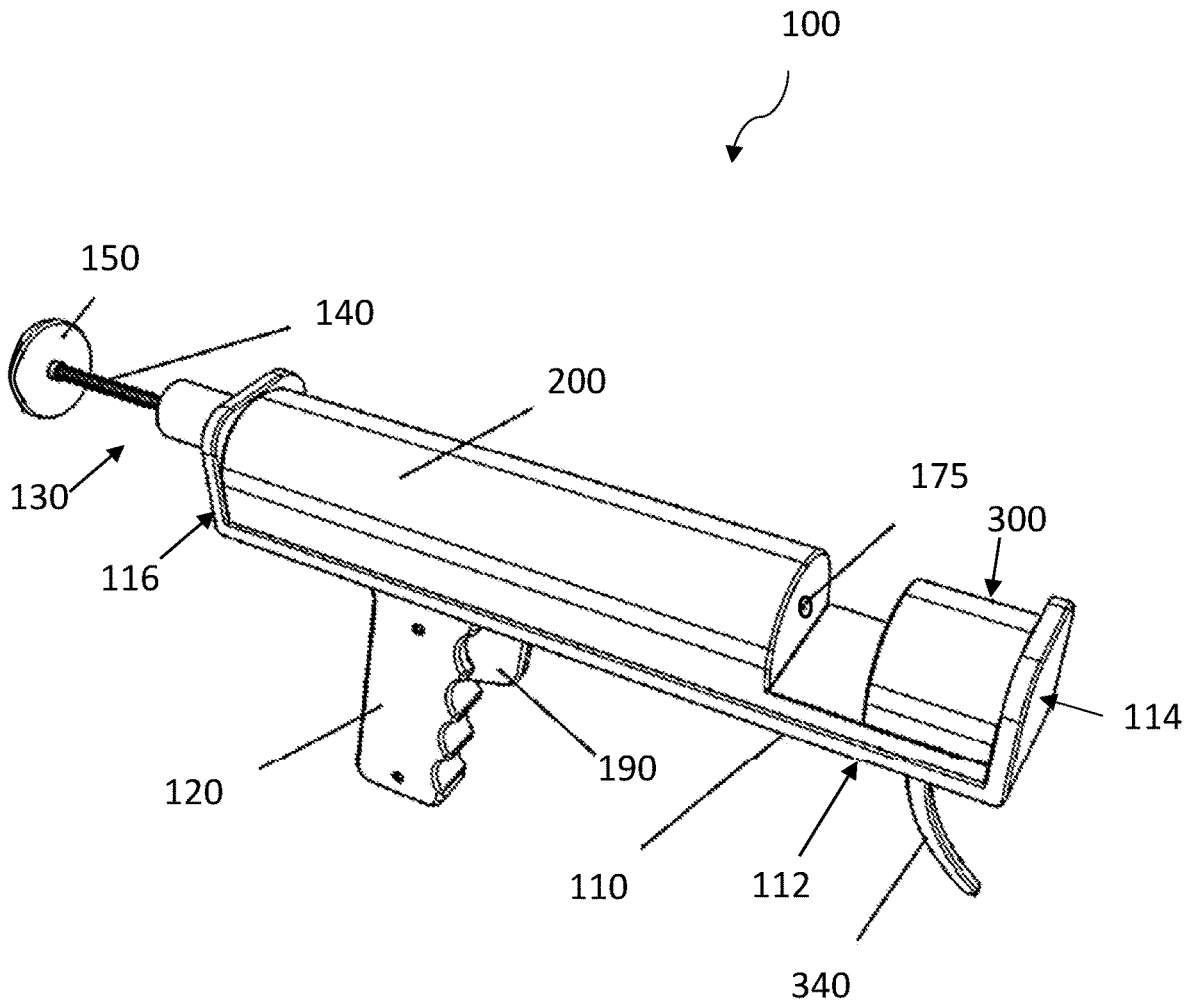
FIG. 1 is a perspective view of an ear-piercing assembly, according to an exemplary embodiment of the present invention.
Figure 2:
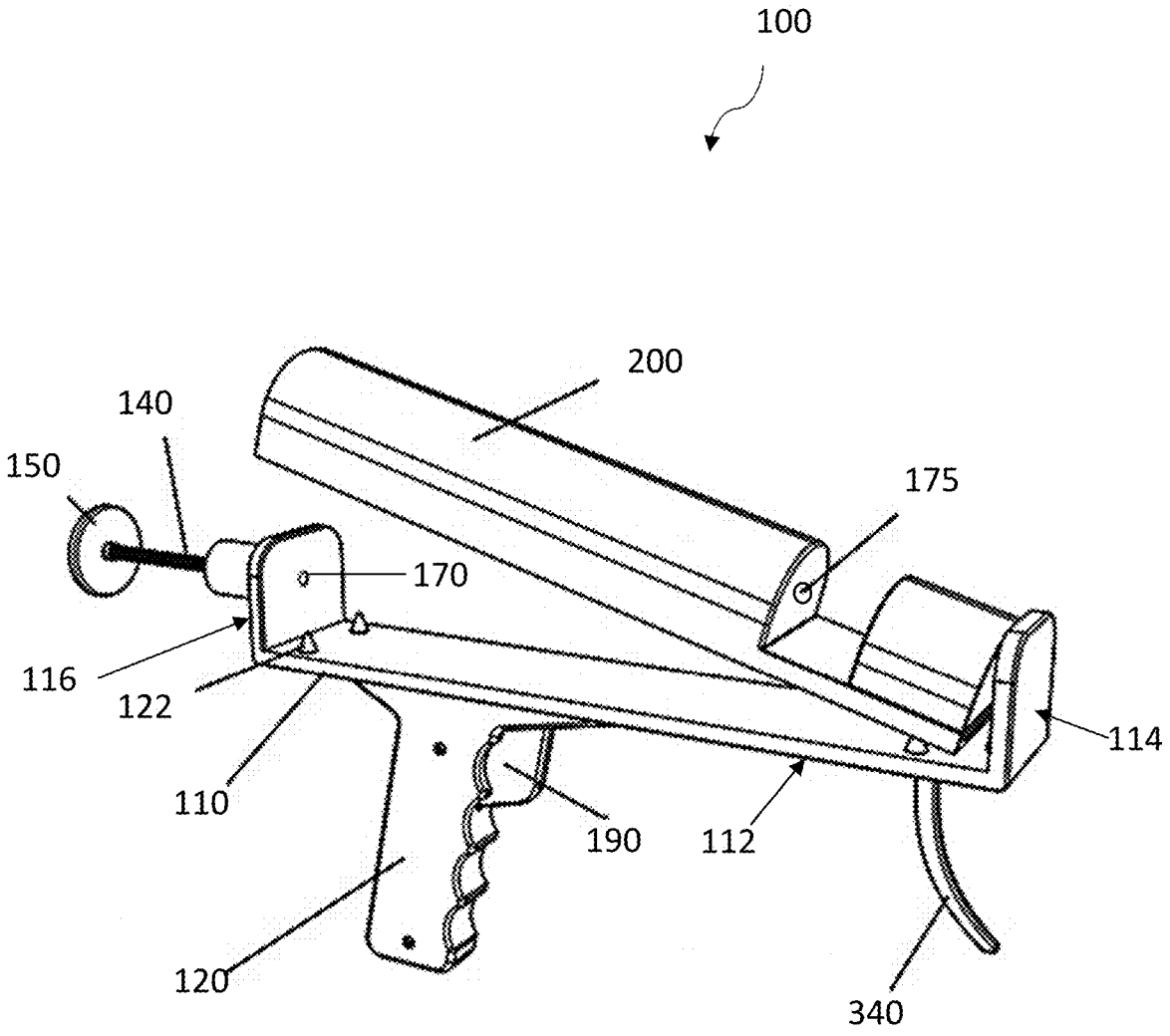
FIG. 2 shows the ear-piercing assembly shown in FIG. 1 and having the cartridge separated from the frame for illustration, according to an exemplary embodiment of the present invention.
Figure 3:
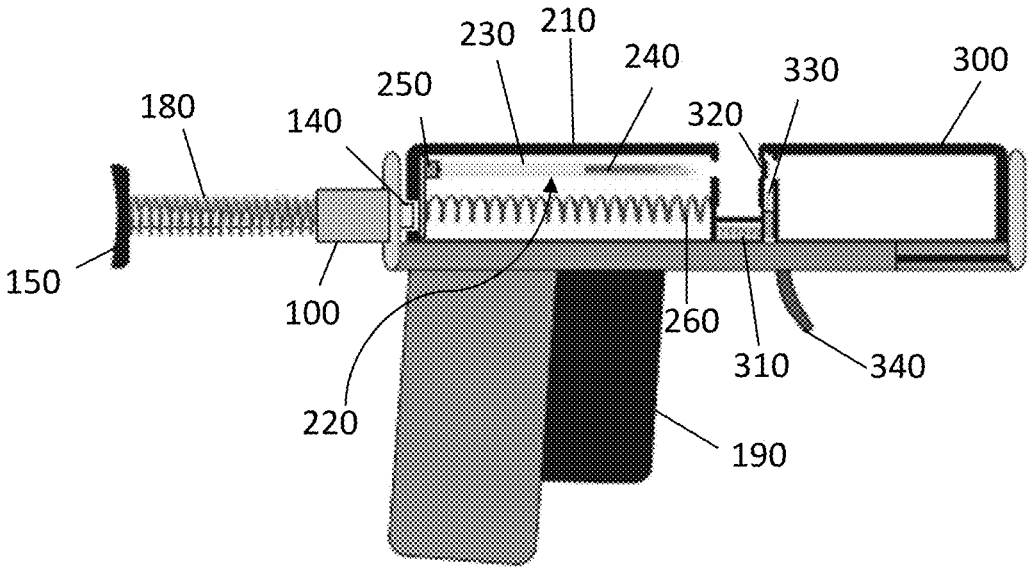
FIG. 3 shows the inner components of the ear-piercing assembly, according to an exemplary embodiment of the present invention.
Figure 5:
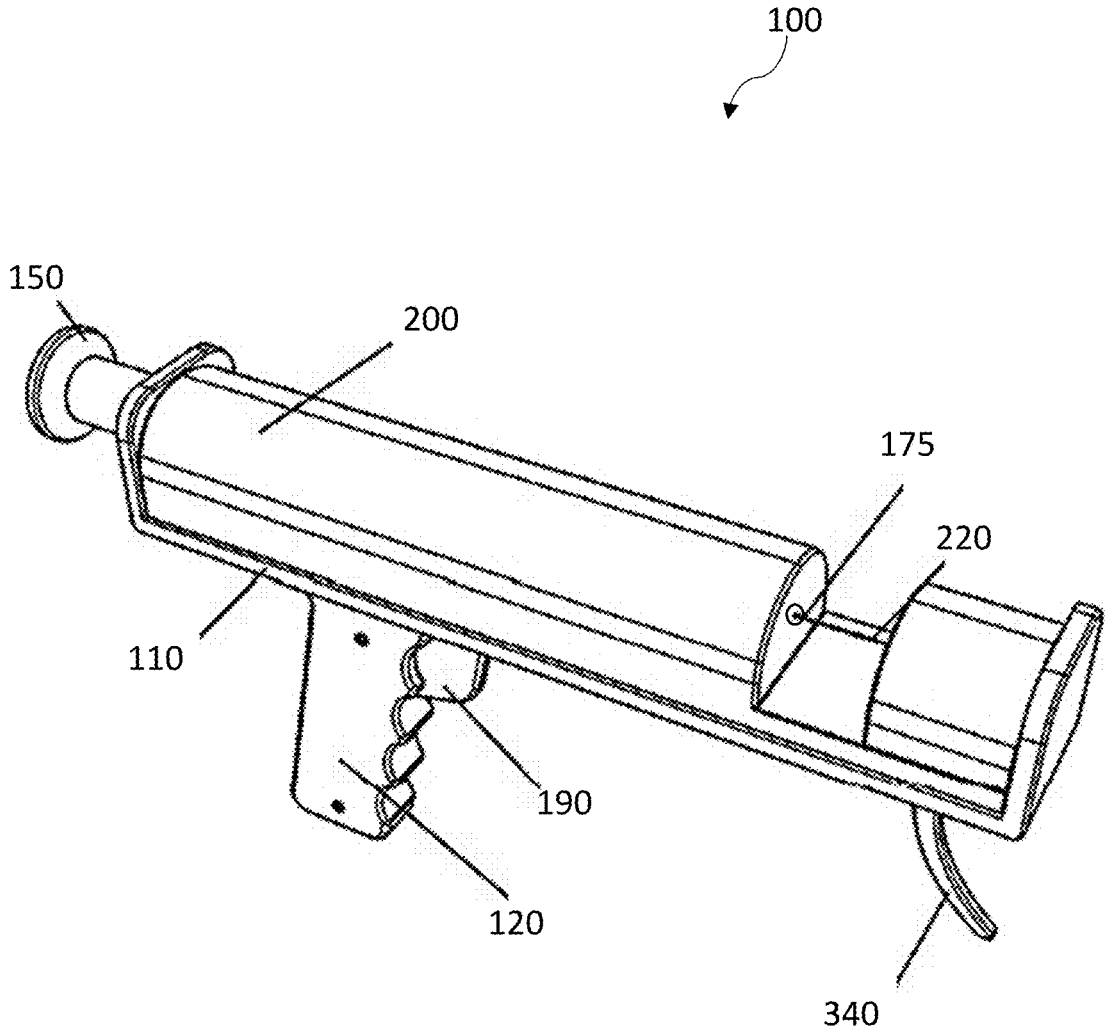
FIG. 5 shows the plunger of the ear-piercing assembly in an extended position and the piercing member inserted into the compression module, according to an exemplary embodiment of the present invention.

Referring to FIGS. 1 and 2 show an exemplary embodiment of the ear-piercing assembly 100 of a gun shape that can be gripped in a hand. The ear-piercing assembly 100 can include a frame 110 that can be of an elongated planar member 112 having a proximal end and a distal end, the proximal end having a front flange 114, and the distal end of the frame having a rear flange 116. A handle 120 can be coupled to the frame 110, wherein the handle 120 can be of geometry, such as the handle can be gripped in a hand. The ear-piercing assembly 100 further includes a plunger unit 130 coupled to the rear flange 116 of the frame. The plunger unit 130 can include a plunger 140 having a head 150 at its one end while the other end i.e., a tail, can slide into an aperture 170 in the rear flange 116 of the frame 110. Referring to FIG. 3 which shows the plunger unit 130 further has a compression spring 180. The compression spring 180 can be an open-coil helical spring that resists compressive forces. The plunger 140 can be actuated from its retracted position by depressing the head 150 of the plunger 140, wherein the plunger 140 slides into the aperture 170 to an extended position. Pushing the head 150 of the plunger 140 may result in compression of the spring 180, which condenses until the external force is removed. The compressed spring 180 in the condensed state returns to its original state and pushes the extended plunger 140 back to the retracted position. FIG. 3 shows the plunger 140 in the retracted position and FIG. 5 shows the plunger 140 in the extended position. While the plunger unit 130 can also have a locking mechanism, such as a snap lock, that allows only forward movement of the plunger but restricts the rearward movement of the plunger, any such locking mechanism that is known to a skilled person is within the scope of the present invention. The locking mechanism can be operably coupled to a trigger 190, wherein actuation of the trigger 190 can release the lock mechanism and the plunger, under the force of the condensed spring 180, can travel back to the retracted position. The trigger 190 can be positioned such as a person gripping the handle can actuate the trigger 190 through his finger.

The ear-piercing assembly 100 can further include a cartridge 200 wherein the cartridge 200 can be interchangeably coupled to the frame 110. The cartridge 200 and the frame 110 can include interlocking mating members 122 that allow coupling the cartridge 200 to the frame 110. Such interlocking mating members may also allow easily removing the cartridge from the frame and replacing it with a new cartridge. For each piercing, a new cartridge can be used, which can be pre-sterilized.

FIG. 3 shows the inner components of the cartridge 200 having a housing 210. Housing 210 includes a piercing member 220. The piercing member 220 can be of an elongated profile having a sleeve part 230 and a needle part 240. The sleeve part 230 can be a suitable medical-grade plastic sleeve made from an inert material, such as nylon. The diameter of the sleeve 230 can be such as to fit in a hole made in the ear lobe by the need part 240. In one case, the sleeve can be about 18 gauge. The needle 240 can also be a medical-grade needle of size, such as 18 gauge. The needle can be hollow having a sharp tip that can puncture the ear lope resulting in a hole. Housing 210 can include a front wall and a rear wall. The rear wall of the housing 210 can be adjacent to the plunger unit 130. The rear wall can include an aperture to receive the plunger. FIG. 3 shows the rear wall of the housing having an aperture adjacent to the plunger 140 and a pusher 250 adjacent to the plunger 140. The pusher 250 can be slidably mounted within the housing and operably coupled to the plunger, wherein driving the plunger also drives the pusher 250. Another compression spring 260 can have one end coupled to the pusher 250 and the other end coupled to the front wall of the housing. The pusher under the driving force of the plunger can compress the spring 260. When the locking mechanism of the plunger is released, both the condensed springs 180 and 260 tend to expand to their original state while pushing the plunger 140 and the pusher 250 back. The sleeve's end of the piercing member 220 can be removably coupled to the pusher 250. The piercing member 220 can be suspended horizontally in the housing, wherein the tip of the piercing member 220 points to an aperture 175 in the front wall of the housing.

Figure 4:
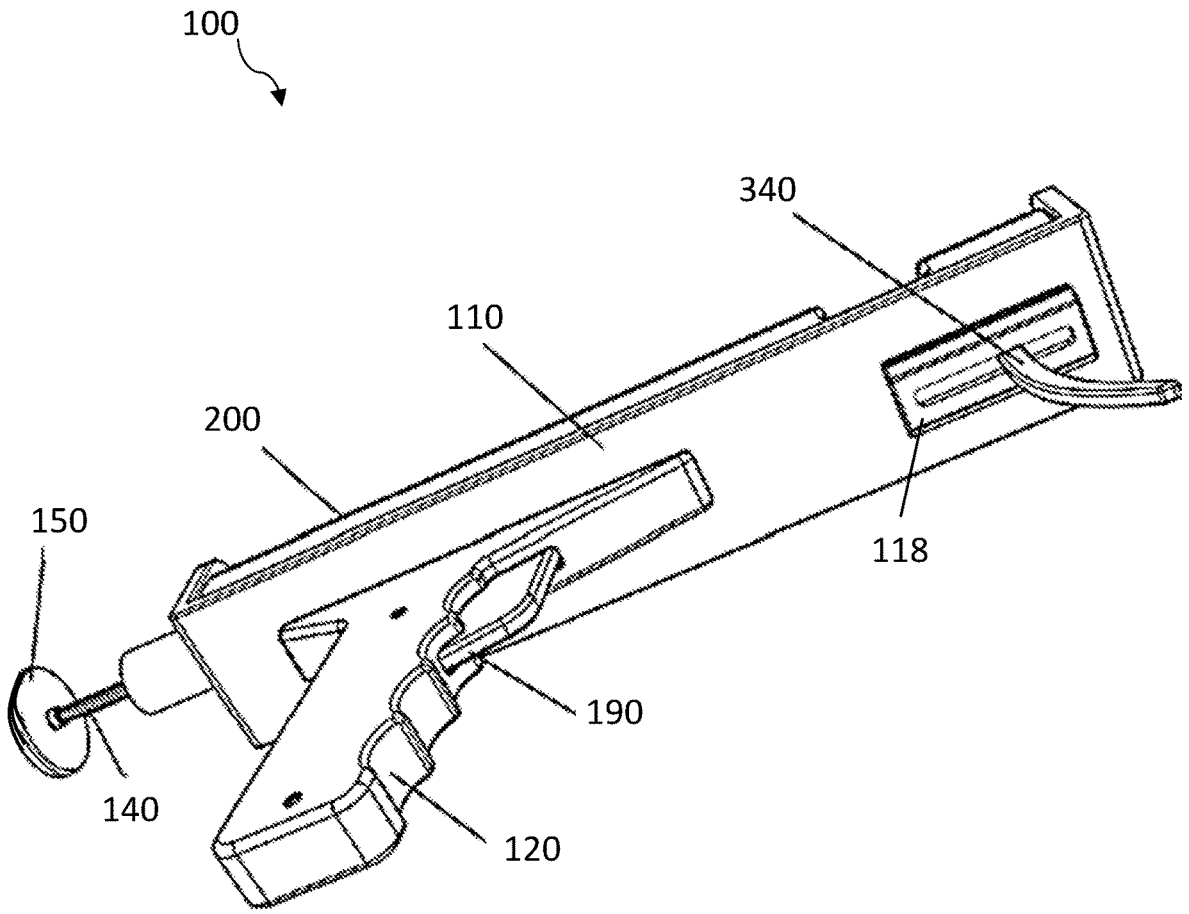
FIG. 4 is a bottom perspective view of the ear-piercing assembly showing the two triggers, according to an exemplary embodiment of the present invention.

The cartridge 200 can further include a compression module 300 adjacent to the front wall of the housing 210. FIG. 3 shows the inner components of the compression module 300 having a front wall and a rear wall. The compression module 300 can be moved towards the housing against the compression of another compression spring 310 for clamping the ear lobe between the housing 210 and the compression module 300. The compression module 300 having a front wall and a rear wall, wherein the rear wall of the compression module 300 can have an aperture for receiving the piercing member 220. Around the aperture can be removably coupled a retention disk 320, the retention disk may also have an aperture 350 (shown in FIG. 6) concentric with the aperture in the rear wall of the compression module 300. The compression module 300 can further include a cutter 330 adjacent to the inner surface of the rear wall, the cutter 330 can snip off the portion of the piercing member received into the compression module 300. The cutter 330 can be actuated by a trigger 340, where the trigger 340 can also release the compression module 300 upon snipping off the piercing member, wherein the condensed spring 310 can move the compression module 300 back to its original position. FIG. 4 shows the first trigger 190 operably coupled to the plunger unit 130 and a second trigger 340 operably coupled to the compression module 300. It can be seen in FIG. 4 that the second trigger 340 protrudes from an elongated slot 118 in the frame 110. The length of slot 118 may allow the displacement of the compression module 300 towards the housing 210, such as the ear lobe is clamped between the two.

Figure 6:
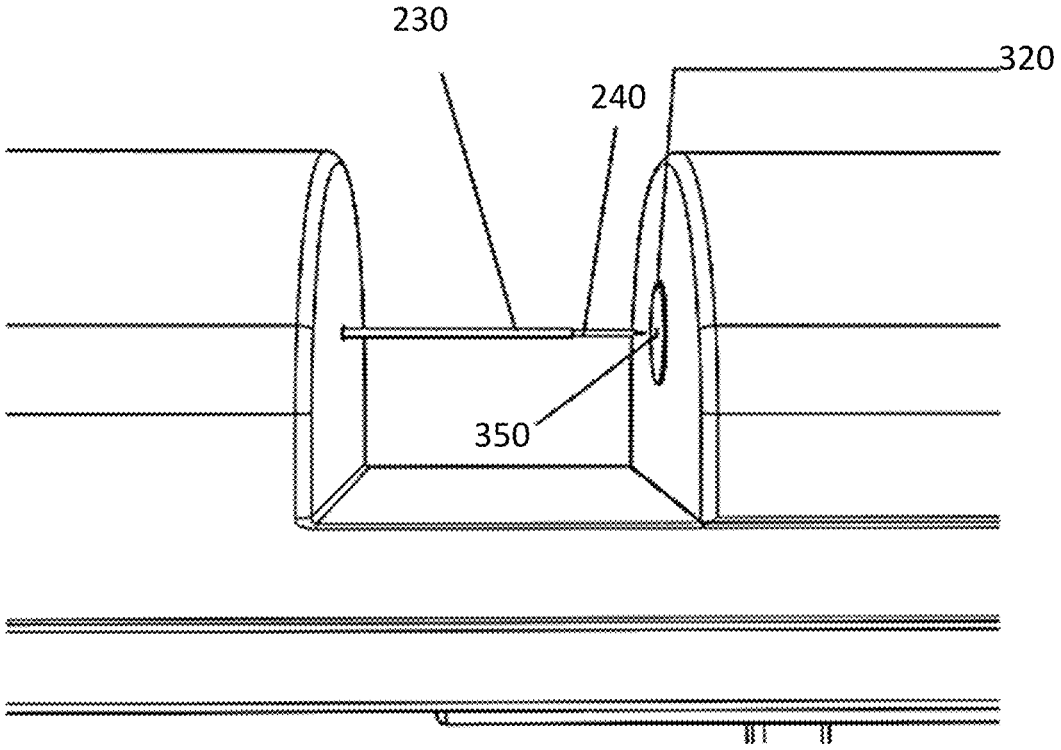
FIG. 6 is a close-up view of the cartridge showing the piercing member and the retention disk, according to an exemplary embodiment of the present invention.
Figure 7:
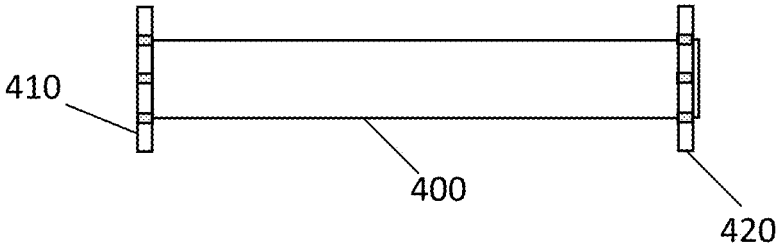
FIG. 7 shows an exemplary embodiment of the piercing member having a retention disk on both ends, according to an exemplary embodiment of the present invention.

In operation, an ear lobe can be cleaned and marked for piercing. A new and sterilized cartridge can be installed in the frame. Thereafter, the disclosed ear-piercing device can be positioned on the ear lobe with the needle aligned to the mark. Thereafter, the compression module of the cartridge can be pressed against the ear lobe clamping like a forceps. Once, the ear-piercing device is stabilized on the ear lobe and the needed aligned with the mark, the plunger can be depressed which drives the needle through the ear lobe into the compression module resulting in the piercing of the ear. The plunger can be continuing to be compressed until it is fully extended and no longer moves. At this point, the needle protrudes from the ear and is replaced by the sleeve. FIGS. 5 and 6 show the ear-piercing device 100 having the plunger fully inserted into the cartridge and the piercing member 220 inserted into the compression module 300. In such as state, the needle protrudes through the aperture in the retention disk 320 followed by the sleeve part of the piercing member 220. FIG. 6 shows a zoomed view of the needle entering the retention disk of the compression module 300. Thereafter, the second trigger 340 can be actuated which in turn drives the cutter to snip off the sleeve protruding behind the retention disk. The wasted sleeve and the needle portion can be collected in the encasing of the compression module and can be disposed of. snipping off the protruded portion of the piercing member is followed by releasing of the compression module 300, which under the return force of the condensed spring is retracted back to its original position. In this process, the retention disc can be separated from the compression module and retained on the ear lobe. The sleeve removably coupled to the pusher can also be separated from the pusher when the ear-piercing device is removed from the ear lobe. In one case, the pusher end of the piercing member 220 can also have a second retention disk, such as the piercing can be protected from both sides by two retention disks. FIG. 7 shows an exemplary embodiment of sleeve 400 with retention disks 410 and 420 at two ends. Adjacent to the second disk 420 can be seen a protruded portion of the sleeve. The sleeve can be hollow such as an earring can be worn in the sleeve, wherein the post of the earring can easily pass through the sleeve. After the healing process, the retention disk 420 can be removed, and the sleeve extracted and discarded, leaving the pierced ear open for normal earring wear.

Additionally, the outer surface of the housing and the outer surface of the compression module which comes in contact with the ear lobe can have teeth for firmly clamping the ear lobe. FIG. 3 shows such teeth on opposing faces that clamp the ear lobe.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. An ear-piercing device comprising:

a frame comprising an elongated planar member having a proximal end and a distal end, an upstanding rear flange coupled to the distal end of the elongated planar member, the rear flange having a first aperture;

a handle coupled to the frame, the handle configured to be gripped in a hand;

a plunger unit coupled to the rear flange of the frame, the plunger unit comprises:

an elongated plunger having a head, the plunger configured to be inserted into the first aperture, the plunger configured to be actuated between a retracted position and an extended position, and a first compression spring configured to bias the plunger in the retracted position;

a cartridge interchangeably coupled to the frame, the cartridge comprises:

a housing having a front wall and a rear wall, the rear wall adjacent to the rear flange, the rear wall having a second aperture configured to receive the plunger, a pusher slidably enclosed within the housing and operably coupled to the plunger, wherein driving the plunger pushes the pusher towards the front wall, and a piercing member encased within the housing and removably mounted to the pusher, the piercing member is aligned perpendicular to the pusher and a tip of the piercing member aligned relative to a third aperture in the front wall;

a compression module configured adjacent to the front wall of the housing, the compression module configured to move towards the front wall of the housing such that an ear lobe can be compressed between the front wall of the housing and the compression module, the rear face of the compression module having a fourth aperture, wherein the third aperture and the fourth aperture are configured such that the piercing member can insert through the third aperture and the fourth aperture into the compression module; and a cutter in the compression module adjacent to the rear face, wherein the cutter is configured to snip off a portion of the piercing member protruded into the compression module.

2. The ear-piercing device according to claim 1, wherein the piercing member comprises a sleeve part and a needle part, the sleeve part is removably coupled to the pusher, the piercing member has a length such that a portion of the sleeve and the needle part are snipped off by the cutter.

3. The ear-piercing device according to claim 2, wherein the sleeve part is hollow and has a diameter such that the sleeve part can be retained in a hole of the ear lobe.

4. The ear-piercing device according to claim 3, wherein the sleeve part is made of nylon and has a size of 18 gauge.

5. The ear-piercing device according to claim 3, wherein the needle part is hollow and configured to make the hole in the ear lobe.

6. The ear-piercing device according to claim 3, wherein the end of the sleeve part is having a retention disc, the retention disc is removably coupled to the pusher, the retention disc configured to be retained on the ear lobe while a remaining portion of the sleeve part retained in the hole of the ear lobe.

7. The ear-piercing device according to claim 1, wherein the plunger unit further comprises a first locking mechanism configured to permit depression of the plunger to the extended position but prevents the return of the plunger, the locking mechanism operably coupled to a first trigger, wherein actuation of the trigger releases the first locking mechanism permitting the plunger to return to the retracted position.

8. The ear-piercing device according to claim 7, wherein the first trigger is positioned adjacent to the handle such that the first trigger can be actuated by a finger of the hand gripping the handle.

9. The ear-piercing device according to claim 1, wherein the cartridge further comprises a second compression spring coupled to the pusher at one end and the front wall at another end.

10. The ear-piercing device according to claim 1, wherein the compression module further comprises a third spring, wherein the third spring configured to resist the movement of the compression module towards the housing.

11. The ear-piercing device according to claim 10, wherein the compression module further comprises a retention disc removably coupled to the rear face of the compression module around the fourth aperture, the retention disc having a fifth aperture, wherein the fifth aperture is concentric with the fourth aperture, the piercing member also configured to protrudes through the fifth aperture, wherein the retention disc is configured to be retained on the piercing member upon the return of the compression module.

12. The ear-piercing device according to claim 11, wherein the piercing member comprises a sleeve part and a needle part, the sleeve part is removably coupled to the pusher, the piercing member has a length such that a portion of the sleeve and the needle part are snipped off by the cutter, the retention disc is retained on a remaining portion of the sleeve part.

13. The ear-piercing device according to claim 12, wherein the sleeve part is hollow and has a diameter such that the sleeve part can be retained in a hole of the ear lobe.

14. The ear-piercing device according to claim 13, wherein the end of the sleeve part is having a second retention disc, the second retention disc is removably coupled to the pusher, the second retention disc configured to be retained on the ear lobe while the remaining portion of the sleeve part is retained in the hole of the ear lobe.

* * * * *